US005124608A

United States Patent [19]

Lawrence et al.

[11] Patent Number: 5,124,608

[45] Date of Patent: Jun. 23, 1992

[54] LOW-NOISE SLIP RING ASSEMBLY

[75] Inventors: David C. Lawrence; Steven L. Grant; John W. Giles, Jr., all of Raleigh, N.C.

[73] Assignee: Quality Aero Technology, Inc., Raleigh, N.C.

[21] Appl. No.: 646,100

[22] Filed: Jan. 25, 1991

[51] Int. Cl.[5] ..... H01R 39/08

[52] U.S. Cl. ..... 310/232; 310/51; 310/143; 310/239; 310/248

[58] Field of Search ..... 310/232, 219, 248, 239, 310/DIG. 6, 143-147, 51

[56] References Cited

U.S. PATENT DOCUMENTS

| | | | |
|---|---|---|---|
| 2,696,570 | 12/1954 | Pandapas | 310/232 |
| 2,950,403 | 8/1960 | Kilner | 310/232 |
| 3,042,998 | 7/1962 | Sweet | 310/232 |
| 3,564,168 | 2/1971 | Bigg | 310/232 |
| 3,686,514 | 8/1972 | Dube | 310/232 |
| 3,959,679 | 5/1976 | Buckley | 310/232 |
| 4,080,540 | 3/1978 | Karube | 310/219 |
| 4,447,752 | 5/1984 | Boyce | 310/232 |
| 4,870,311 | 9/1989 | Chase | 310/232 |

FOREIGN PATENT DOCUMENTS

| | | | |
|---|---|---|---|
| 3136500 | 6/1982 | Fed. Rep. of Germany | 310/232 |
| 0037382 | 7/1923 | Norway | 310/232 |

*Primary Examiner*—R. Skudy

*Attorney, Agent, or Firm*—Curtis, Morris & Safford

[57] ABSTRACT

A slip ring assembly having a rotatable chamber including a shaft rotatably mounted therein. A plurality of slip rings are provided within a ring section of the rotatable chamber and are mounted to the shaft for rotation therewith. The plurality of slip rings for a group of preselected pairs of slip rings. An electrical conductor is connected to each slip ring with each electrical conductor being twisted to at least one adjacent electrical conductor through a central core in the shaft to thereby cancel alternating current due to self-generated voltages. The slip ring assembly also includes a brush assembly having at least one brush support associated with each slip ring with each brush support having brushes extending therefrom in contact with its corresponding slip ring at at least two brush contacts. The brush contacts for each slip are orientated approximately 180 degrees apart. Furthermore, brush contacts for each preselected pair of adjacent slip rings are orientated at an offset of approximately 90 degrees.

21 Claims, 3 Drawing Sheets

LOW-NOISE SLIP RING ASSEMBLY

BACKGROUND OF THE INVENTION

This invention relates to a slip ring assembly used to transmit electrical signals from a rotating shaft to a stationary system, and more particularly, to a internal wiring arrangement for a slip ring assembly which minimizes electrical noise due to rotational effects at high speeds.

Typically, high speed slip rings are used to connect sensors on rotating components to stationary data acquisition equipment. The sensors are usually temperature sensors or strain gages. Each sensor requires two or more independent contacts on the slip ring to make a complete circuit. According to Ohm's Law, linear, homogeneous, isotropic mediums exhibit the characteristic that the voltage equals the current multiplied by the resistance for any closed loop ($V=IR$). Sensors make use of this law by holding either the voltage or the current constant and measuring the change in the other. The change in current or voltage which the circuit measures is the output of the sensor. A common problem, however, is that the surroundings of the slip ring, or even the slip ring itself, may contain magnetic fields. While the slip ring shaft is rotating, the current goes in on one contact and returns on another to complete a circuit. The result is a current loop which rotates through magnetic flux lines. This phenomena induces an alternating current in the circuit. In the case of a slip ring, this alternating current appears as undesirable background noise which decreases the clarity of the sensor signal. On the output, the alternating current is a sine wave with the period equal to the period of rotation of the slip ring shaft.

Another factor of importance is the internal resistance of the circuit. All conductors have a resistivity, $\rho$, which is characteristic of the material. The resistance of any conductor may then be calculated using the relationship of $R=\rho L/A$, where L is the length of the conductor and A is the cross-sectional area. The internal resistance of a circuit may then be calculated using the path length that the electrical signal must travel. In the case of a slip ring circuit, the current enters the slip ring at the brush-ring interface, continues through the sensor and then leaves the slip ring at another brush-ring interface. Continuity from the ring to the sensor, however, is made at only one point on the ring. The result of this is that as the ring rotates and the brush-ring contact point remains stationary, the electrical signal path length changes, and as the path length changes, the internal resistance of the circuit changes. This varying resistance causes an alternating current on the output signal and its shape is determined by the number of brush-ring contact points for each channel, and the angular orientation of the ring-wire contact points for each ring. This once per revolution signal interferes with the output generated by the sensor.

OBJECTS OF THE INVENTION

Therefore, it is an object of the present invention to provide a slip ring assembly used to transmit electrical signals from sensors rotating in a gas turbine engine to stationary data acquisition equipment which avoids the aforementioned disadvantages of the prior art.

Another object of this invention is to provide an electrical slip ring for data transfer in which the internal wiring provides cancellation of alternating current due to self-generated voltages.

A further object of this invention to provide a geometrical configuration for brush-ring contact points that cancels the varying internal resistance of each slip ring circuit.

Various other objects, advantages and features of the present invention will become readily apparent from the ensuing detailed description, and the novel features will be particularly pointed out in the appended claims.

SUMMARY OF THE INVENTION

In accordance with an aspect of the present invention, a slip ring assembly is provided which is used to transmit electrical signals from rotating sensors to a stationary data acquisition system. The rotor assembly of the slip ring assembly includes a rotatable shaft mounted for rotation in the slip ring assembly. A plurality of slip rings are provided within a ring section of the rotor assembly and are mounted to the shaft for rotation therewith. The plurality of slip rings form a group of preselected pairs of adjacent slip rings. The shaft includes a central core formed therein and a plurality of conductor conduits leading from the ring section of the chamber to the central core of the shaft.

An electrical conductor is connected to each of the slip rings. The electrical conductors connected to each of the preselected pairs of adjacent slip rings run untwisted adjacent to each other through the ring section and one of the plurality of conductor conduits, until the electrical conductors reach the central core of the shaft. In accordance with one of the general objects of this invention, the electrical conductors connected to each preselected pair of adjacent slip rings are twisted together through the central core of the shaft to cancel alternating current due to self-generated voltages. The paired electrical conductors remain twisted together until the electrical conductors are secured to a printed circuit board disposed at the opposite end of the rotor assembly from the ring section.

The present invention also provides an electrical configuration for the brush-ring contact points that cancels the varying internal resistance of each slip ring circuit. In accordance therewith, the present invention includes a brush assembly having at least one brush support associated with each slip ring with each brush support being in contact with its corresponding slip ring at at least two brush contacts. The brush contacts for each slip ring are orientated approximately 180 degrees apart, and the brush contacts for each preselected pair of adjacent slip rings are orientated at an offset of approximately 90 degrees.

BRIEF DESCRIPTION OF THE DRAWINGS

The following detailed description, given by way of example, but not intended to limit the invention solely to the specific embodiments described, may best be understood in conjunction with the accompanying drawings in which.

DETAILED DESCRIPTION OF A PREFERRED EMBODIMENT

Figure 1:
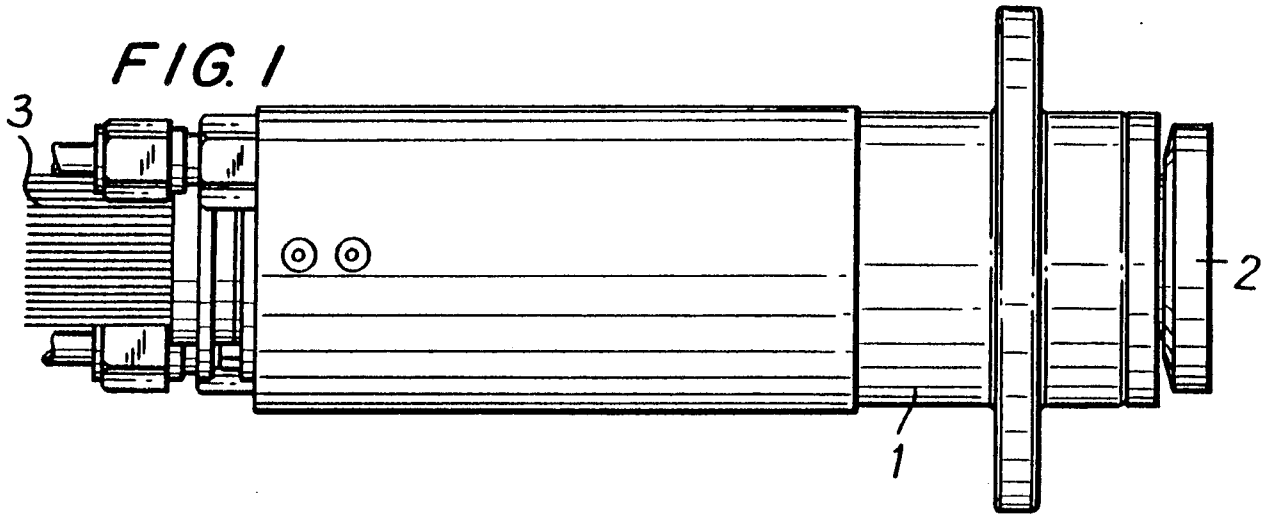
FIG. 1 is a front elevational view of a slip ring assembly to be used in conjunction with the teachings of the present invention.

Referring now to FIG. 1, a slip ring assembly is illustrated which is used to transmit small electrical signals from a rotating shaft to a stationary data acquisition 8 system. The slip ring assembly includes a bearing housing 1, a rotor assembly 2, and a wiring harness 3 that contains the output contacts.

Figure 2:
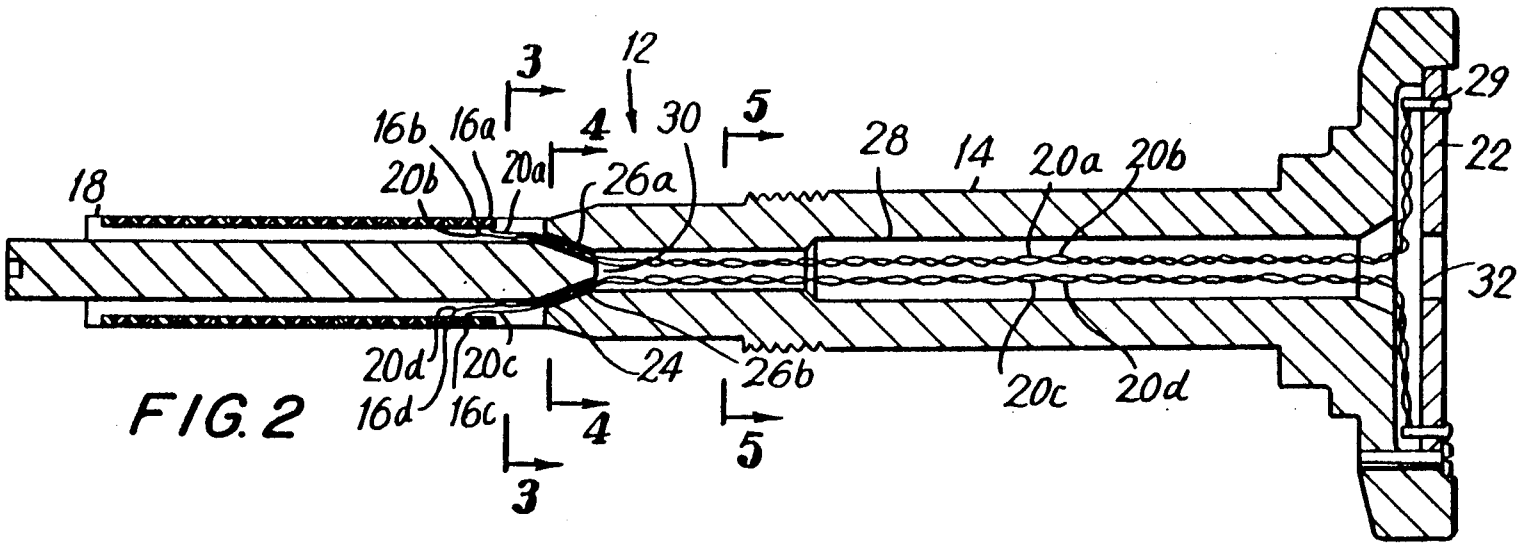
FIG. 2 is front cross-sectional view of a preferred embodiment for a rotor assembly of the present invention which can be incorporated within the slip ring assembly of FIG. 1.
Figure 3:
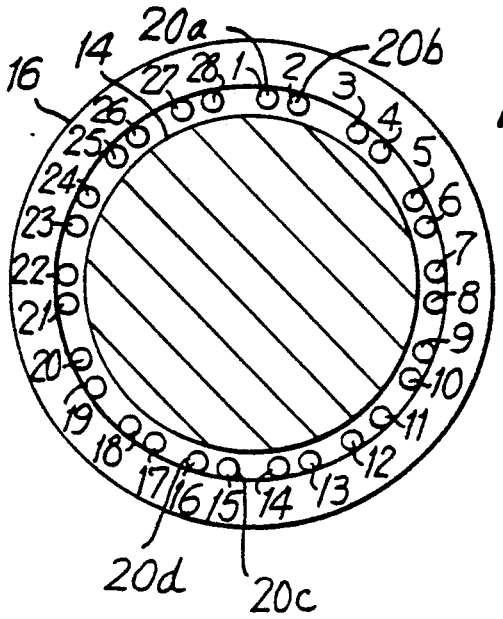
FIG. 3 is a side cross-sectional view taken along line 3—3 of FIG. 2 specifically illustrating the internal wiring configuration of the electrical conductors through the ring section of the rotor assembly.

The rotor assembly 2 of the present invention is more specifically illustrated in FIG. 2. The rotor assembly 2 defines a rotatable chamber 12 having a shaft 14, preferably made of stainless steel, mounted therein for rotation therewith. A plurality of slip rings, such as 16*a*, *b*, *c* and *d*, etc., are provided within a ring section 18 of the rotatable chamber 12. The slip rings 16*a*, *b*, *c*, *d*, etc. are mounted to the shaft 14 for rotation therewith. Although any number of slip rings can be provided in the ring section, in one preferred embodiment as is shown in FIG. 1, 28 slip rings made of gold are provided.

In order to supply an electrical signal to each slip ring, an electrical conductor, such as 20*a*, *b*, *c* and *d*, etc., is welded to the inner surface of each of the slip rings 16*a*, *b*, *c*, and *d*, etc, respectively. For instance, as shown in FIG. 2, electrical conductor 20*a* is welded to the inner diameter of slip ring 16*a*, and electrical conductor 20*b* is welded to the inside diameter of slip ring 16*b*.

As is shown in FIG. 2, as adjacent slip rings 16*a* and *b* are assembled on the shaft 14, the adjacent rings are orientated so that their corresponding pair of electrical conductors, such as 20*a and b*, associated therewith run untwisted immediately adjacent or generally parallel to each other, between the shaft and the slip rings in the ring section. Similarly, the pair of electrical conductors 20*c* and *d* connected to slip rings 16*c* and *d*, respectively, run untwisted adjacent to each other between the shaft and the slip rings in the ring section. These paired conductors run along the shaft 14 between the slip rings and the shaft until they reach the front end 24 of the ring section 18.

Figure 4:
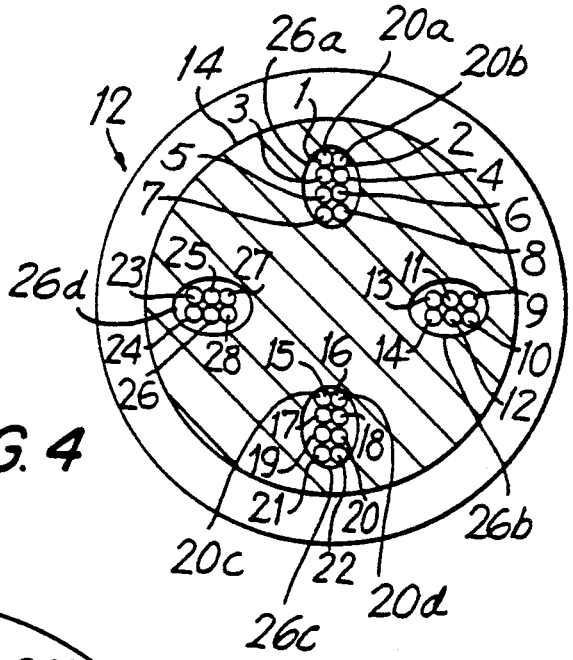
FIG. 4 is a side cross-section view taken along line 4—4 of FIG. 2 specifically illustrating the internal wiring configuration of the electrical conductors through the conductor conduits formed in the shaft.

As is shown in FIGS. 2 and 4, the shaft 14 includes a plurality of conductor conduits, such as 26*a*, *b*, *c* and *d*, etc., inclined from the ring section 18 to a central core 28 of the shaft. At the front end 24 of the ring section the electrical conductors connected to each preselected pair of adjacent slip rings run untwisted adjacent to each other through one of the conductor conduits. For instance, as shown in FIG. 4, paired electrical conductors 20*a* and *b* run through conductor conduit 26*a* and paired electrical conductors 20*c* and *d* run through conductor conduits 26*c*.

In the preferred embodiment, four conductor conduits 26*a*, *b*, *c*, and *d* are provided between the ring section 18 and central core 28 of the shaft (see FIG. 4). Although the number of paired conductors running through each conductor conduit may vary, in the illustrative embodiment of FIG. 4, four pairs of conductors run through conductor conduits 26*a* and *c* and three pairs of conductors run through conductor conduits 26*b* and *d*.

Figure 5:
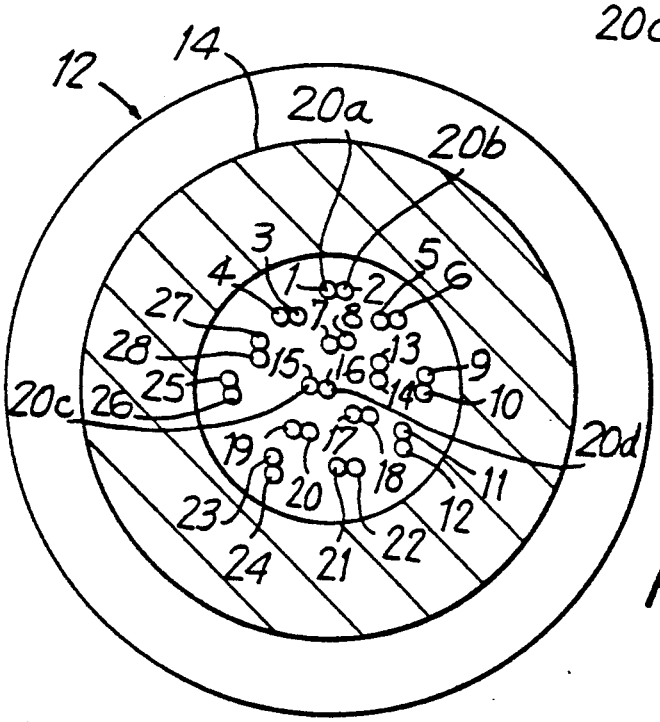
FIG. 5 is a side cross-sectional view taken along line 5–5 of FIG. 2 specifically illustrating the internal wiring configuration of the electrical conductors through the central core in the shaft.

The internal wiring configuration of the electrical conductors minimizes the noise carried by the slip ring from self-generated voltages. These voltages are caused by the lead wires on the shaft rotating off centerline and cutting any magnetic fields that may be present. These fields may be very weak, such as the Earth's magnetic field, or they may be from a local source, such as a magnetized engine part. In order to achieve a minimization of the noise carried by the slip rings from self-generated voltages, when the paired electrical conductors reach the end 30 of the central core 28 adjacent to the conductor conduits 26*a*, 26*b*, etc., the paired electric conductors, such as 20*a*, *b*, and 20*c* and *d*, are twisted together and remain twisted longitudinally through the central core for a substantial distance until they are secured to socket contacts 29 of a printed circuit board 22 disposed at the front portion 32 of the rotor assembly 2 (see FIG. 2 and 5). Accordingly, sensor termination is paired so that one circuit includes two ring contacts whose conductors are twisted together. As a result of this internal wiring configuration, as the slip ring shaft rotates in any magnetic flux lines, the twisting of the wires cancels the alternating current effect.

Figure 6:
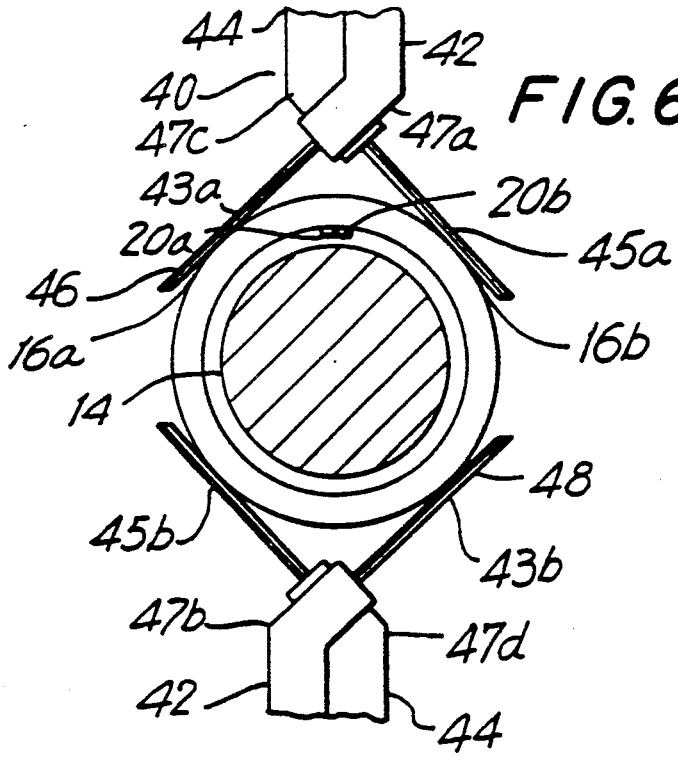
FIG. 6 is a side cross-sectional view of a preferred embodiment of the brush-ring interface for two brush-ring supports used in conjunction with the rotor assembly of FIG. 2.
Figure 7:
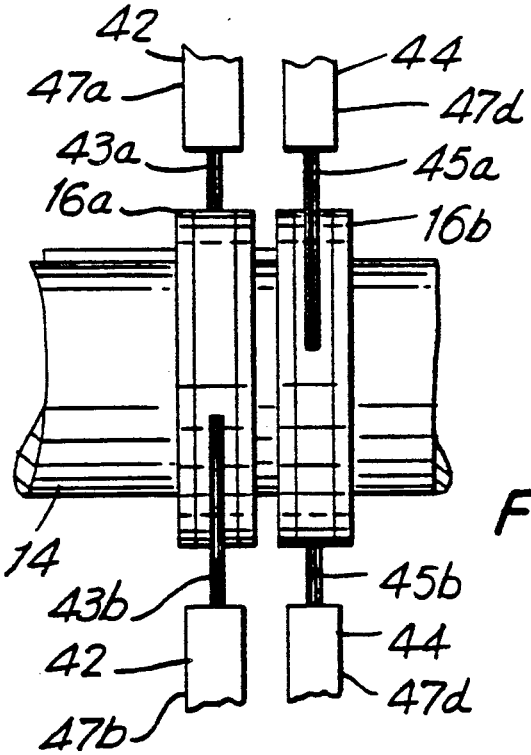
FIG. 7 is a front elevational view of the brush/ring interface configuration of FIG. 6.

FIGS. 6 and 7 illustrate the brush assembly 40 of the present invention which provides a geometrical configuration for the brush-ring contact points that cancels the varying internal resistance of each slip ring circuit. The brush assembly includes a plurality of stationary angled brush supports, such as 42 and 44, etc., which are connected to stationary data acquisition equipment (not shown). Each brush support is associated with one of the plurality of slip rings, and includes an angled generally downwardly extending support arm, such as 47*a* and *c*, and an angled upwardly extending support arm, such as 47*b* and *d*. For purposes of illustration, only two brush supports are illustrated; namely: brush support 42 is associated with slip ring 16*a* and brush support 44 is associated with slip ring 16*b*.

Each brush support 42 and 44 includes two relatively short brushes, such as 43*a* and *b* and 45*a* and *b*, respectively, extending from the support arms toward the slip rings. The brushes are in contact with its corresponding slip ring at at least two brush contact points, 46 and 48, respectively. As shown in FIGS. 6 and 7, the brush contacts for each slip ring are orientated approximately 180 degrees apart. The electrical conductors welded to the inner diameter of the slip rings then rotate relative to these brush ring contact points. At any point in time, the electrical signal may thus travel from the electrical conductor through the slip ring to either brush contact point. These two possible paths act as parallel resistors and the equivalent resistance is accordingly the resistance of the first half of one complete circuit.

Additionally, brush ring contact points for the preselected pairs of slip rings, such as the pair of slip rings 16*a* and *b*, which completes the circuit are staggered or offset 90 degrees (see FIGS. 6 and 7). In this configuration, and due to the ring-wire contact points for adjacent rings being immediately adjacent to each other, as the resistance increases for one ring contact, it accordingly decreases for the adjacent ring contact. The result is that the total internal resistance of the circuit varies much less than it would with the brush ring contact at any other orientation. For instance, in this orientation, the alternating current effect is reduced by up to 75%.

Furthermore, since the brush support arms are angled and the brushes extending therefrom are relatively short, the slip rings herein are able to rotate both clockwise and counterclockwise.

While the present invention has been particularly shown and described with reference to certain preferred embodiments, it will be readily apparent to those of ordinary skill in the art that various changes and modifications may be made without departing from the spirit and scope of the invention. It is intended that the appended claims be interpreted as including the foregoing as well as various other such changes and modifications.

What is claimed is:

1. A slip ring assembly comprising:

a rotor assembly defining a chamber which has a rotatably mounted shaft including a central core formed therein;

a plurality of slip rings provided within a ring section of said chamber and mounted to said shaft for rotation therewith; and an electrical conductor being connected to each of said plurality of slip rings, each electrical conductor being twisted together to at least one adjacent electrical conductor longitudinally through said central core of said shaft for a substantial distance therethrough to thereby cancel alternating current due to self-generated voltages.

2. The slip ring assembly of claim 1 wherein said plurality of slip rings form a group of preselected pairs of adjacent slip rings.

3. The slip ring assembly of claim 2 wherein the electrical conductors connected to each preselected pair of adjacent slip rings are twisted together through said central core of said shaft.

4. The slip ring assembly of claim 3 wherein said shaft includes a plurality of conductor conduits leading from said ring section to said central core of said shaft.

5. The slip ring assembly of claim 4 wherein the electrical conductors connected to each of said preselected pairs of adjacent slip rings run untwisted adjacent to each other through said ring section and one of said plurality of conductor conduits.

6. The slip ring assembly of claim 1 wherein each electrical conductor is secured to an inner surface of a corresponding one of said plurality of slip rings at a slip ring contact point.

7. The slip ring assembly of claim 6 wherein each electrical conductor is connected between its corresponding said contact point and pick-up means provided at the opposite end of said chamber from said ring section.

8. The slip ring assembly of claim 7 wherein said pick-up means is a printed circuit board.

9. The slip ring assembly of claim 2 and further including a brush assembly having at least one brush support associated with a corresponding one of said plurality of slip rings with each said brush support having brushes extending therefrom in contact with its corresponding said slip ring at at least two brush contacts.

10. The slip ring assembly of claim 9 wherein said brush contacts for each slip ring are orientated approximately 180 degrees apart.

11. The slip ring assembly of claim 9 wherein said brush contacts for each preselected pair of adjacent slip rings are oriented at an offset of approximately 90 degrees.

12. A slip ring assembly comprising:

a rotor assembly defining a chamber which has a rotatably mounted shaft including a central core formed therein:

a plurality of slip rings mounted to said shaft for rotation therewith said plurality of slip rings forming a group of preselected pairs of adjacent slip rings; and an electrical conductor being connected to each of said plurality of slip rings, each electrical conductor being twisted together to at least one adjacent electrical conductor longitudinally through said central core of said shaft for a substantial distance therethrough;

a brush assembly having at least one angled brush support associated with a corresponding one of said plurality of slip rings with each said brush support having brushes extending therefrom in contact with its corresponding said slip ring at least two brush contacts.

13. The slip ring assembly of claim 12 wherein said brush contacts for each said slip ring are orientated approximately 180 degrees apart.

14. The slip ring assembly of claim 12 wherein said brush contacts for each preselected pair of adjacent slip rings are orientated at an offset of approximately 90 degrees.

15. The slip ring assembly of claim 12 wherein each brush support includes an angled generally downwardly extending support arm and an angled generally upwardly extending support arm.

16. A slip ring assembly comprising:

a rotor assembly defining a chamber which has a rotatably mounted shaft including a central core formed therein;

a plurality of slip rings provided within a ring section of said chamber and mounted to said shaft for rotation therewith and forming a group of preselected pairs of adjacent slip rings;

said shaft including a plurality of conductor conduits leading from said ring section to said central core of said shaft;

an electrical conductor connected to each of said plurality of slip rings, said electrical conductors connected to each preselected pair of adjacent slip rings being twisted together longitudinally through said central core of said shaft for a substantial distance therethrough an running untwisted adjacent to each other through said ring section and one of said plurality of conductor conduits thereby forming a preselected pair of electrical conductors; and a brush assembly having at least one brush support associated with a corresponding one of said plurality of slip rings with each said brush support having brushes extending therefrom in contact with its corresponding said slip ring at least two brush contacts, said brush contacts for each said slip ring being orientated approximately 180 degrees apart, and said brush contacts for each preselected pair of adjacent slip rings being orientated at an offset of approximately 90 degrees.

17. The slip ring assembly of claim 16 wherein each electrical conductor is secured to an inner surface of one of said plurality of slip rings at a slip ring contact point.

18. The slip ring assembly of claim 17 wherein each electrical conductor is connected between said contact point and pick-up means provided at the opposite end of said chamber from said ring section.

19. The slip ring assembly of claim 18 wherein said pick-up means is a printed circuit board.

20. The slip ring assembly of claim 16 wherein a plurality of said preselected pairs of electrical conductors run through each of said conductor conduits.

21. A rotor assembly for a slip ring assembly comprising:

a rotatable shaft having a central core formed therein;

a plurality of slip rings mounted to said shaft for rotation therewith; and a plurality of electrical conductors being connected to said slip rings with each electrical conductor being twisted together to at least one adjacent electrical conductor longitudinally through said central core of said shaft for a substantial distance therethrough to thereby cancel alternating current due to self-generated voltages.

* * * * *